United States Patent [19]

Autio

[11] Patent Number: 5,046,266

[45] Date of Patent: Sep. 10, 1991

[54] MULTI-CYLINDER DRYER WITH TWIN-WIRE DRAW AND WEB TRANSFER BETWEEN THE CYLINDER GROUPS

[75] Inventor: Jukka Autio, Jyväskylä , Finland

[73] Assignee: Valmet Paper Machinery Inc., Finland

[21] Appl. No.: 546,876

[22] Filed: Jul. 2, 1990

Related U.S. Application Data

[62] Division of Ser. No. 444,810, Dec. 1, 1989, Pat. No. 4,967,489.

[30] Foreign Application Priority Data

Dec. 14, 1988 [FI] Finland ..... 885789
Dec. 14, 1988 [FI] Finland ..... 885790

[51] Int. Cl.[5] ..... D21F 5/00; D21F 5/04

[52] U.S. Cl. ..... 34/120; 34/115; 34/117; 162/375

[58] Field of Search ..... 34/115, 117, 120; 162/375, 290

[56] References Cited

U.S. PATENT DOCUMENTS

| | | | |
|---|---|---|---|
| 3,816,941 | 6/1974 | Holik et al. | 34/117 X |
| 3,874,997 | 4/1975 | Kankaanpää | 34/115 X |
| 4,000,035 | 12/1976 | Schiel et al. | 34/115 X |
| 4,172,007 | 10/1979 | Kankaanpää | 34/115 X |
| 4,481,723 | 11/1984 | Venenpää | 34/117 X |
| 4,485,567 | 12/1984 | Ely | 34/115 |
| 4,744,156 | 5/1988 | Futcher | 34/117 X |
| 4,835,881 | 6/1989 | Welsby | 34/117 |
| 4,881,327 | 11/1989 | Hauser et al. | 34/117 X |
| 4,905,380 | 3/1990 | Eskelinen et al. | 34/23 |
| 4,953,297 | 9/1990 | Eskelinen et al. | 34/23 |

*Primary Examiner*—Henry A. Bennett
*Assistant Examiner*—Christopher Kilner
*Attorney, Agent, or Firm*—Steinberg & Raskin

[57] ABSTRACT

Multi-cylinder dryer, has upper cylinder (13,14,15,16) and lower cylinders (10,11,12) over which a paper web (W) to be dried is run in meandering fashion from one cylinder onto the next cylinder. The paper web is in direct contact with each drying cylinder within a sector that is larger than 180°. An upper wire (5) and a lower wire (6) are used to press the paper web against faces of the drying cylinders (10,11,12; 13,14,15,16). The wires (6,5) are guided by guide rolls, which are placed in such a way that the paper web (W) is continuously supported by a wire (5,6) as it runs from one cylinder onto the other. The guide roll arrangements consist of fragmentary rolls (21,51), which are supported on suction boxes (20) and/or on blow boxes (50) so that at least two fragmentary rolls (21,51) are supported on each suction box (20)/blow box (50). By means of the suction boxes (20)/blow boxes (50), blowings (S,P) are directed at the drying wire (5,6). The blowings improve a support contact between the paper web (W) and the wire (5,6) and/or pocket ventilation.

9 Claims, 7 Drawing Sheets

MULTI-CYLINDER DRYER WITH TWIN-WIRE DRAW AND WEB TRANSFER BETWEEN THE CYLINDER GROUPS

This is a division of application Ser. No. 444,810, filed Dec. 1, 1989, now U.S. Pat. No. 4,967,489, issued Nov. 6, 1990.

BACKGROUND OF THE INVENTION

The invention relates to a multi-cylinder dryer having upper drying cylinders and lower drying cylinders over which a paper web to be dried is run in meandering fashion from one cylinder onto the nest cylinder. The paper web is in direct contact with each drying cylinder within a sector that is larger than 180°. The dryer includes an upper wire and a lower wire arranged to press the paper web against the faces of the drying cylinders. The wires are guided by guide rolls, which are placed to support the paper web continuously by a wire as the web runs from one cylinder to the next cylinder.

In a further aspect, the invention concerns a multi-cylinder dryer, having several sequential cylinder groups, of which the cylinder groups in a former group employs a single-wire draw or twin-wire draw, and wherein a latter group employs a twin-wire draw. In the wire draws, the wires are arranged to guide the paper web to be dried via the drying cylinders, the wires being guided by guide rolls.

As it is known in prior art, a multi-cylinder dryer of a paper machine comprises two lines of drying cylinders placed one line above the other, the web being guided in meandering fashion over said cylinders. In a multi-cylinder dryer, different cylinder groups are employed, such as wire groups and drive groups. In a latter one of the groups power of rotation of the cylinders is passed to all the cylinders belonging to the same group by means of a common drive shaft and a gear transmission.

In recent years, the running speeds of paper machines have been increasing constantly, and now the limit of 1500 m/min is approaching. As a result, fluttering of the web and detaching of the web from a support fabric constitute a serious problem that hampers the running quality of a paper machine.

As is known in prior art, in multi-cylinder dryers, so-called twin-wire draw is employed, wherein the paper web has free gaps when it moves from one cylinder line to the other. Moreover, especially in the initial part of a multi-cylinder dryer, so-called single-wire draw is employed, wherein the drying wire is arranged to support the web also when the web moves from one cylinder line to the other. In such case, on one line of cylinders, the drying cylinders remain inside the loop of the drying wire, and on the other line of cylinders they remain outside the loop.

The present invention is applied in particular in connection with so-called twin-wire draw, which, in the present application, means a mode of supporting and drawing the web in connection with heated drying cylinders wherein on the upper cylinders an upper wire is used and on the lower cylinders, in a corresponding way, a lower wire is used. The wires are guided by faces of the drying cylinders and by transfer rolls placed in the spaces between the cylinders. Thereby, on the upper line of cylinders, the web is pressed into direct drying contact with the face of an upper cylinder and, in a corresponding way, the web is pressed by the lower wire against the face of a lower cylinder.

In a twin-wire draw, the web has usually had substantially long open passages as it runs from one cylinder line onto the other. These open passages have been susceptible to fluttering breaks and wrinkles in the web, which drawback has become more serious with increasing running speeds of the paper machines. The drawback has been manifested with particular emphasis in the initial part of the drying section, where the web is still relatively moist and therefore, of low strength, and where its elastic properties encourage fluttering. Attempts have been made to eliminate this drawback by making the open draws of the web shorter in the initial part of the drying section, and by placing imaginary planes passing through the axes of the upper and lower cylinder lines at a shorter distance from one another than that which has been usually customary or would be optimal, e.g. in view of the efficiency of drying.

Conversion of a 3rd and a 4th drying group to a single-wire draw has also been used. But this is an emergency solution, because it results in reduced evaporation capacity and makes it more difficult to arrange the air-conditioning.

Attempts have been made to solve the problems of running quality in the drying section, resulting from increased running speeds of the paper machines, by moving over to single-wire draw. Since this lowers the drying capacity of the machine, this solution is, as a rule, not advisable, except where it is necessary, i.e. in the first and the second drying group. In the other groups, in a drying section, attempts are made to operate with twin-wire draw, which is preferable in view of the drying capacity.

One prior art solution for twin-wire draw is described in the U.S. Pat. No. 3,250,019, wherein the object is to provide a fully closed draw. In this prior art solution, the wire of the preceding group accompanies the paper web up to the suction zone of the following wire. However, there is a drawback in the sense that the paper web cannot be brought tightly into a pocket formed by the cylinder and the wire; excessively long free gaps remain for the web.

Another prior art solution is described in the DE Patent No. 36 23 971, wherein the object is also to provide a fully closed draw. There is, however, a drawback that excessively long free gaps remain for the paper web, with resulting fluttering.

With the use of the prior art arrangements, the draw of the paper web in the gaps between the groups of cylinders in a multi-cylinder dryer has become problematic. If an open draw of the web is applied in the group gaps, it causes fluttering of the web with resulting risk of break of the web and inferior running quality.

Moreover, in prior art, in the group gaps, it has been necessary to use quite a large difference in speed, which stretches the web detrimentally.

In ways known in prior art, attempts have been made to solve the above problems of the draw of the web in the group gaps in a multi-cylinder dryer by various means, such as overlapping of the wire guide rolls, whereby it has been attempted to close the open draw of the web in the group gaps. As further aid, various blow boxes have been used. By means of these solutions, it has however, not been possible to avoid all the problems. As an additional drawback, more difficult threading of the web has been experienced.

One prior art solution is described in the FI Patent Application No. 871493. In this prior art solution, the web is passed from one group to the other by means of a particular group gap cylinder. However, such a group gap cylinder has a large size, and it has no heating effect, so that passing of the web over a group gap cylinder does not promote the drying of the web. Moreover, when such a large diameter group-gap cylinder is used, the spaces between the groups become congested.

SUMMARY OF THE INVENTION

The object of the present invention is to provide a twin-wire draw wherein none of the drawbacks of the prior art solution occur. The object of the invention is in particular to provide such a twin-wire draw for the drying section of the paper machine to increase the drying capacity of the paper machine as well as to permit a shortening of the length of the paper machine.

A further object of the invention is to provide a twin-wire draw that permits threading of the web without a rope.

An object of the invention is also to provide such a transfer of the web in the gaps between cylinder groups that the problems common in prior art do not occur in the web transfer.

A further object of the invention is also to provide such a transfer of the web in the gaps between cylinder groups that between the cylinders no congested space is formed with several rolls, thereby avoiding difficulty in removal of broken web.

It is a particular object of the invention to provide a transfer of the web in the gaps between cylinder groups such that no large diameter group-gap cylinders are needed between the cylinders.

Another object of the invention is to provide such a transfer of the web in the gaps between cylinder groups which avoid the foregoing problems common in the prior art during threading of the web.

The twin-wire draw in accordance with the invention in a multi-cylinder dryer is mainly characterized in that the guide roll arrangement consists of fragmentary rolls and that the fragmentary rolls are supported on suction boxes and/or blow boxes so that at least two fragmentary rolls are supported on each suction box and/or blow box. Also, by means of the suction boxes and/or the blow boxes streams of air are directed at the drying wire which improve the support contact between the paper web and the web and/or pocket ventilation.

The group-gap draw in accordance with the invention in a multi-cylinder dryer is mainly characterized in that in the gaps between the cylinder groups, there is a transfer of the paper web from one drying group to the next between the last cylinder in a former group and the first cylinder in a latter group in an outside tangential plane of the cylinders, preferably in an outside tangential plane between the upper cylinders. This enables the paper web arriving from the former group to run into contact with the wire of the following drying group, so that, during the transfer, the paper web is kept in contact with the delivering wire/receiving wire by means of a suction box/blow box. Furthermore, a fragmentary roll of small diameter is attached to the end of the suction box/blow box. The fragmentary roll is supported and journalled while using the suction box/blow box as a support frame. Thereby, a suction/blow zone starts as close to the face of the receiving cylinder/-delivering cylinder as possible.

Owing to the twin-wire draw of the invention, the wire coverage in the drying section of the paper machine can be increased by about 30 per cent, whereby an increased drying capacity is obtained.

When a twin-wire draw in accordance with the invention is employed, the length of the paper machine can be made shorter, even through, true enough, the height of the drying section is increased somewhat. But this is not a drawback, because the press section in the paper machine is higher.

By means of a twin-wire draw in accordance with the invention, threading of the web without a rope is also permitted, which is a considerable advantage.

When a twin-wire draw in accordance with the invention is used, the suction box related to the twin-wire draw can also be used for regulation of the profile.

In principle, a transfer of the web in group gaps in accordance with the invention can also be carried out so that, in the group gaps, the transfer of the paper web from one drying group to the other takes place between lower cylinders in an outside tangential plane of the lower cylinders. This, however, makes the removal of broken web more difficult, so that the transfer of the web in the tangential plane between the upper cylinders, described above, is the preferred solution.

When a group-gap transfer in accordance with the invention is used, it is possible to eliminate the first drying cylinder in each group, for example a UNO-VAC roll or a UNO-ROLL roll, depending on at which location in the paper machine the group-gap transfer is used. In this way, in an ordinary machine, economies of about 5 or 6 drying cylinders/rolls are obtained.

It is a further advantage of the group-gap transfer in accordance with the invention that no web threading ropes are needed, but the group gaps are run without threading ropes.

When a group-gap transfer in accordance with the invention is used, the gaps between the cylinder groups also become open, whereby an advantage is obtained in case of break and in removal of broken web.

It is a further advantage of the group-gap transfer in accordance with the invention that the web can be fetched from very close to the last roll in the preceding group, whereby no long free gap is formed. In such a case, in almost closed draw is obtained, whereby problems resulting from fluttering are avoided.

The group-gap draw in accordance with the invention can be applied both in a single-wire area and in a twin-wire area and also in transfers between such areas.

Also, when a fragmentary roll in accordance with the invention is used in the group-gap transfer of the paper web, an improved control of the deflections of the rolls is permitted.

BRIEF DESCRIPTION OF THE DRAWINGS

The following invention will be described in more detail with reference to some exemplifying embodiments illustrated in the figures in the accompanying drawing, the invention being by no means strictly confined to the details of said embodiments, wherein.

DETAILED DESCRIPTION

Figure 1A:
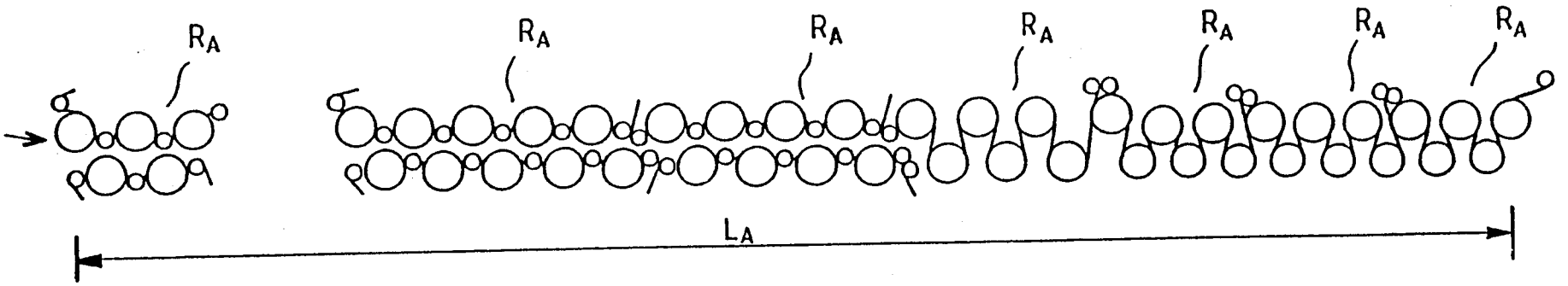
FIG. 1A PRIOR ART
FIG. 1A is a schematically illustration of a prior art solution of the drying section of a paper machine.
Figure 1:
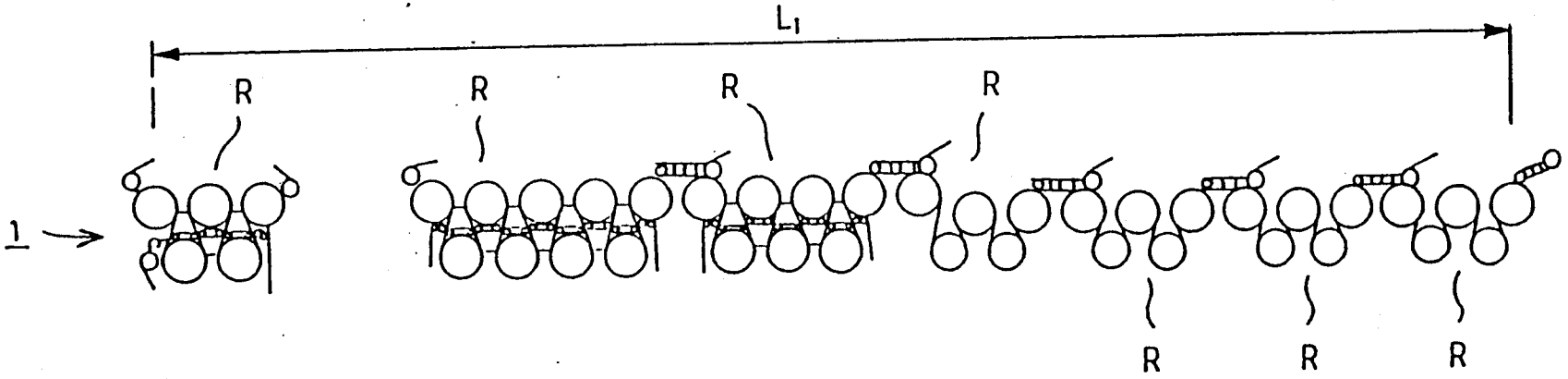
FIG. 1 shows diagramatically apparatus in accordance with the invention for the drying section of a paper machine.

FIG. 1A shows a prior art apparatus of a drying section A of a paper machine. In FIG. 1, the reference numeral 1 denotes a drying section of a paper machine in accordance with the invention. When a twin-wire draw in accordance with the invention is employed, the wire coverage formed is about 30 per cent larger than in the prior art apparatus of FIG. 1A. Also, when a group-gap transfer in accordance with the invention is used in the drying section of a paper machine, compared with the prior art apparatus shown in FIG. A, considerable economies are obtained in the overall length. In the drying section 1, in accordance with the invention, one cylinder has been eliminated from each group R, whereby the overall length $L_1$ constituted by the groups R in accordance with the the invention is shorter than the overall length $L_A$ constituted by the groups $R_A$ in accordance with the apparatus of FIG. 1A. In the apparatus, in accordance with the invention, the economies obtained in the drying section of a paper machine allow construction with about 5 or 6 cylinders.

Figure 2:
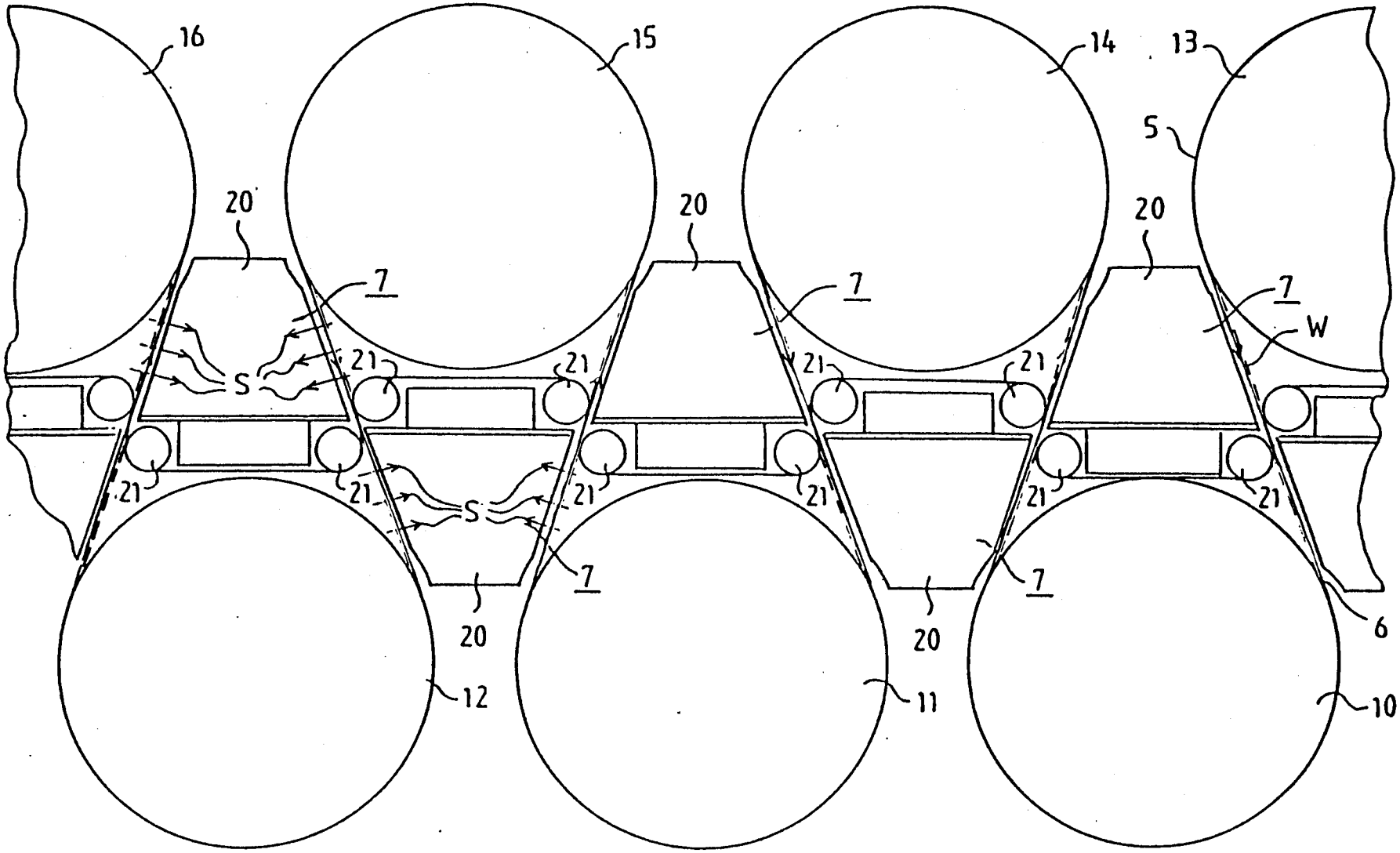
FIG. 2 is a schematic illustration of an exemplifying embodiment of a twin-wire draw in accordance with the invention, wherein a suction box is employed.

In the twin-wire draw in accordance with the invention shown in FIG. 2, the upper wire 5 runs from the upper cylinder 13 via the wire transfer device 7 onto the next upper cylinder 14. In a corresponding way, there are wire transfer devices 7 between the upper cylinders 14 and 15 as well as 15 and 16.

The lower wire 6 is passed from the lower cylinder 10 via the wire transfer device 7 further onto the lower cylinder 11. Between the lower cylinders 11 and 12 there is a corresponding wire transfer device 7.

The wire transfer device 7 comprises a suction box 20, to which two fragmentary rolls 21 are attached. The fragmentary rolls 21 are attached to the suction box 20 so that, when the wire 5 comes from the cylinder 13, it runs along the side of the suction box 20 onto the first fragmentary roll 21 and from there further in a horizontal plane onto the fragmentary roll 21, from where it runs further along the side of the suction box 20 onto the upper cylinder 14. The lower wire 6 runs in a corresponding way from the lower cylinder 10 via the side of the suction box 20 onto the fragmentary roll 21, from there further in a horizontal plane onto the second fragmentary roll 21 and further down onto the next lower cylinder 11 parallel to the side of the suction box 20.

The location of the fragmentary rolls 21 in the wire transfer device 7 of the upper wire 5 and of the lower wire 6 are constructed in such a way that the upper wire 5 and the lower wire 6 overlap one another over a certain passage, i.e. the lower wire 6 fetches the paper web W from the upper wire 5 and the other way around. The paper web W is supported by means of the suction box 20 of the wire transfer device 7 placed in the pockets of the drying wire 5.6.

Negative pressure is employed in the suction box 20. The suction openings on the suction box 20 are placed at the sides of the suction box so that the air flows pass in the direction shown by the arrow S.

Figure 3:
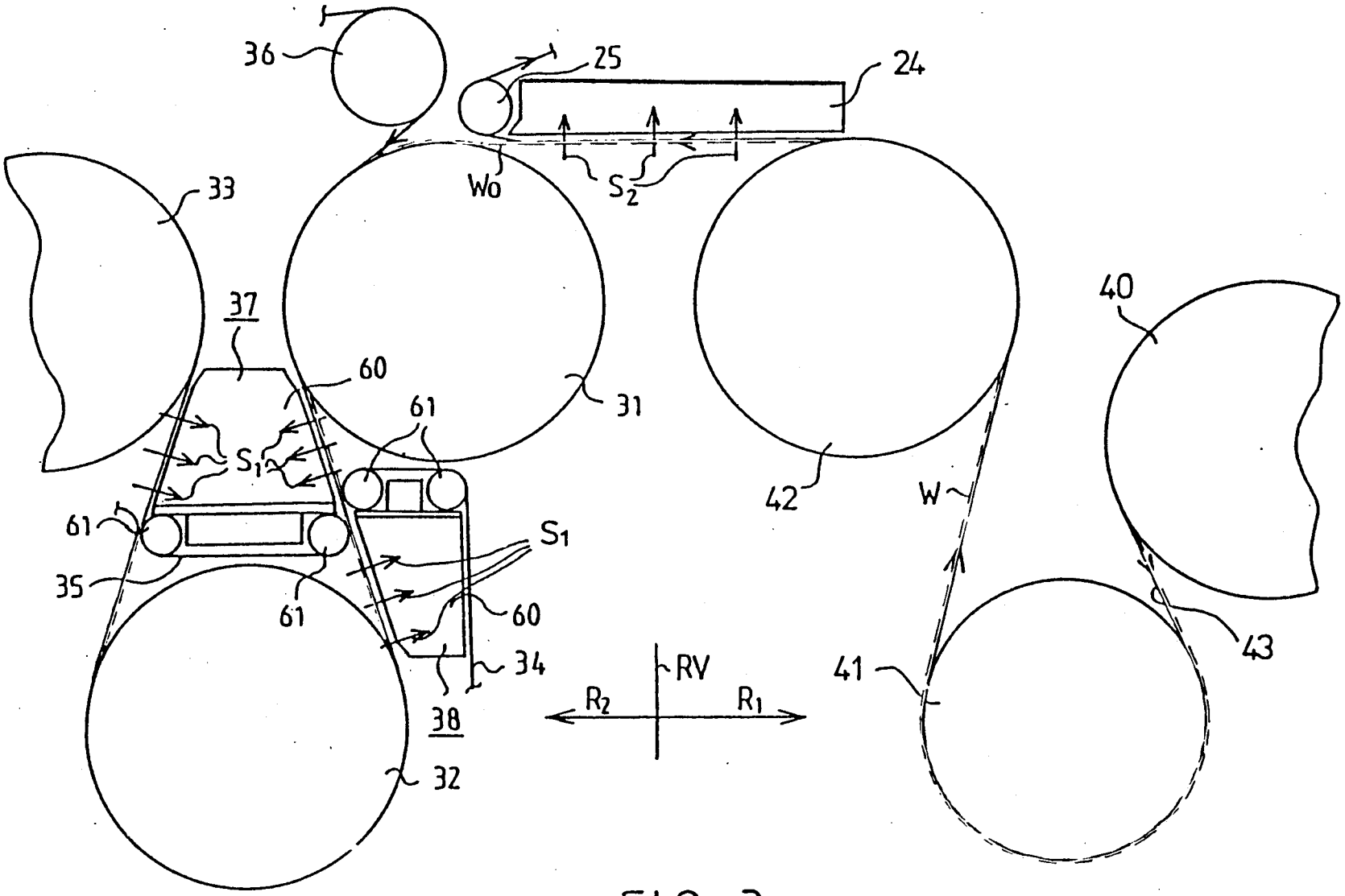
FIG. 3 is a schematic illustration of a group-gap transfer in accordance with the invention, with feeding of the paper web and provided with a suction box.

In FIG. 3, the gap between cylinder groups is illustrated by the line RV. The group gap RV is formed between the groups $R_1$ and $R_2$. Of the preceding groups $R_1$, the upper cylinders 40 and 42, as well as the lower cylinder 41, are shown. In the group $R_1$ single-wire draw is employed. In the figure the wire is denoted with the reference number 43. In the group $R_1$, the web W runs from the top side of the upper cylinder 40 via the bottom side of the lower cylinder 41 and further onto the upper cylinder 42. The paper web W is supported by the wire 43, on the upper cylinders 40 and 42 between the wire 43 and the cylinder 40 or 42, respectively, and on the lower cylinder 41 outside the wire 43 and the cylinder 41.

In the latter group $R_2$, twin-wire draw is employed The upper wire is denoted with the reference numeral 35 and the lower wire with the numeral 34. Of the group $R_2$, the upper cylinders 31 and 33 as well as the lower cylinder 32 are shown. Moreover, in the figure, the upper-wire guide roll 36 and the transfer equipment 37 are shown. The transfer equipment of the lower wire 34 is denoted by reference numeral 38. The paper web W runs between the upper wire 35 and the upper cylinder 31 and moves further to between the lower wire 34 and the lower cylinder 32 and further to between the upper wire 35 and the upper cylinder 33. In twin-wire draw, the wire 34,35 transfer equipment 37,38 comprises a suction box 60, wherein the air flows $S_1$ are directed in accordance with the arrows shown in the figure through the holes made into the side walls of the suction box 60 into the suction box 60. Wire guide rolls 61 are attached to the suction box 60. Each transfer equipment 37,38 comprises two wire guide rolls 61, which consist of a construction of a fragmentary roll type in a way corresponding to a fragmentary roll 25 used in the group-gap transfer, which will be described in more detail below.

According to the invention, in the group gap RV, the transfer of the paper web W from one drying group $R_1$ to the other group $R_2$ takes place from the last cylinder 42 in the preceding group $R_1$ onto the first cylinder 31 in the following group $R_2$ in an outside tangential plane between the cylinder 42,31. Most advantageously, the transfer of the paper web W in the group gap RV takes place between the upper cylinders 42 and 31 in the outside tangential plane of the upper cylinders 42,31. The paper web W arriving from the group $R_1$ is run into contact with the wire 35 of the following drying group. For the time of the transfer, the paper web W is kept in contact with the delivering wire 43 by means of the suction box 24. To the end of the suction box 24, a small diameter fragmentary roll 25 is attached in order that the suction zone could be made to extend as close to the face of the receiving cylinder 31 as possible, whereby the free portion $W_o$ of the paper W, i.e. the portion of the paper web W on which the paper web W is not supported by a wire, becomes as short as possible. The air flows produced by the suction box 24, denoted with the arrows $S_2$ in the figure, support the paper web on the wire during the group gap transfer. The length of the free portion $W_o$ of the paper web W is just about 50 mm. Negative pressure is employed in the suction box 24, and the suction openings are placed at the side of the suction box 24 in accordance with the arrows $S_2$, whereby a suction force is formed at the side of the suction box. The suction face is planar and placed in the outside tangential plane between the upper cylinders 31,42. The suction face produces the support of the wire 43 and of the paper web W.

Figure 4:
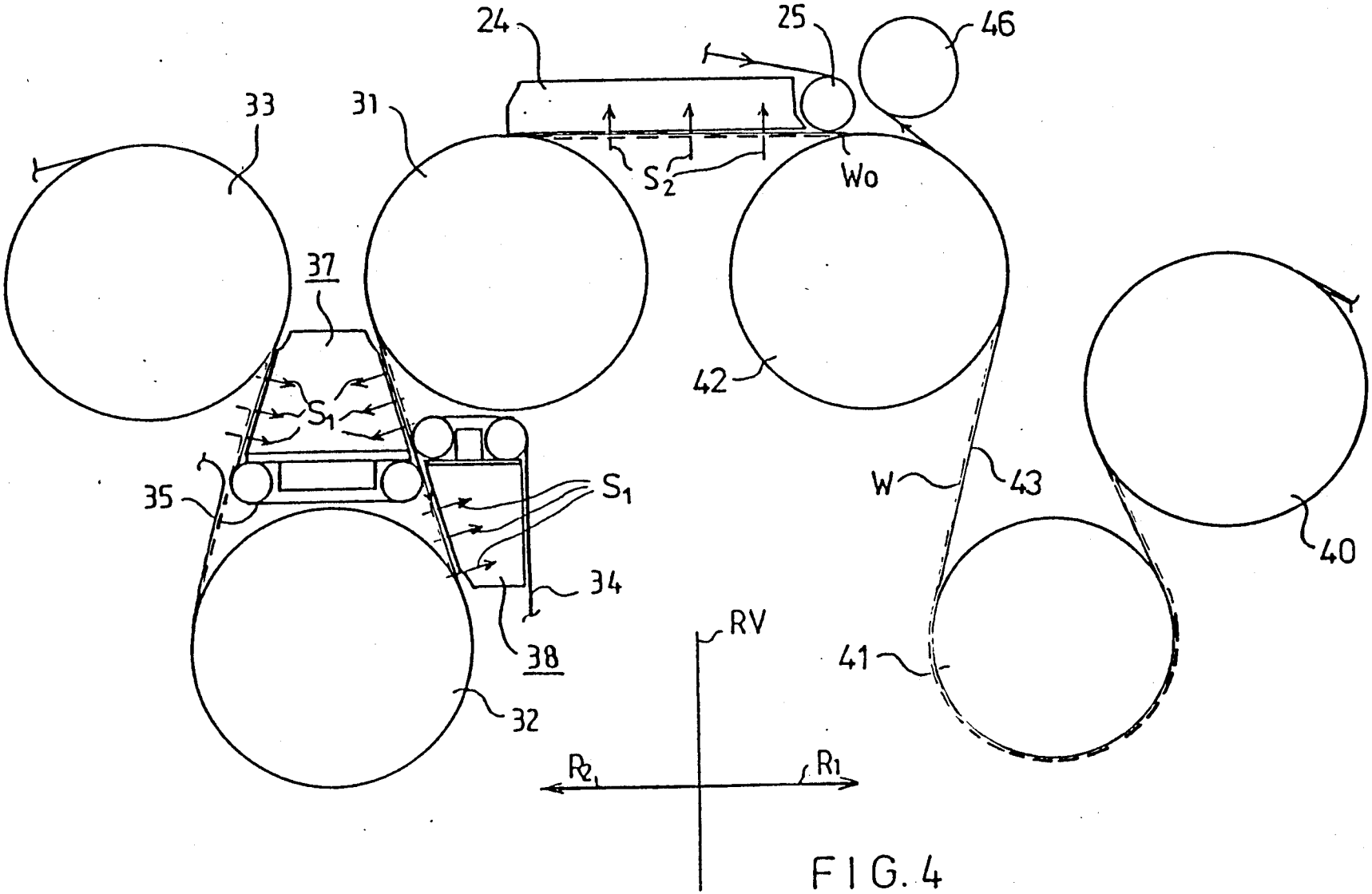
FIG. 4 is a schematic illustration of a group gap transfer in accordance with the invention, with fetching of the paper web and provided with a suction box.

FIG. 4 shows a second exemplifying embodiment of the group-gap transfer in accordance with the invention, wherein in the group gap RV, the transfer of the paper web W from one drying gap $R_1$ to the other group $R_2$ takes place in a horizontal plane between the upper cylinders 42 and 31. The paper web W arriving from the group $R_1$ is run into contact with the wire 35 of the following drying group. For the time of the transfer, the paper web W is kept in contact with the new wire 35 by means of the suction box 24. to the end of the suction box 24, a small diameter fragmentary roll 25 is attached in order that the suction roll can be made to start as close to the face of the delivering cylinder 42 as possible.

Figure 5:
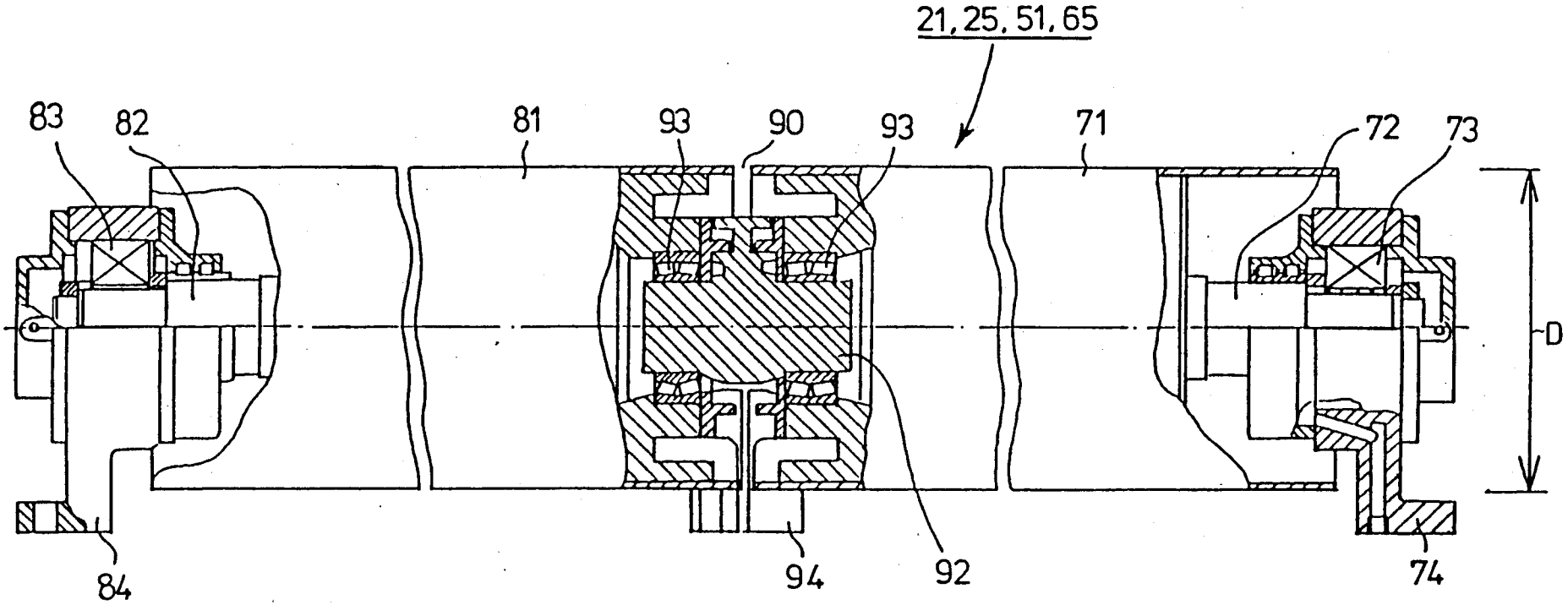
FIG. 5 shows a side view of a fragmentary roll, particularly in section in accordance with the invention.

In the exemplifying embodiment of the fragmentary roll 21,25,51,65 in accordance with the invention shown in FIG. 5, the fragmentary roll is composed of two components rolls 71 and 81, the component roll 71 is supported on a flange 74 by one of its ends by means of a shaft 72 and its journalling 73. By means of the flange 74, the fragmentary roll is supported on a corresponding suction box FIGS, 2, 3 and 4). In a corresponding way, the second component roll 81 of the fragmentary roll is supported on a flange 84 by one of its ends by means of a shaft 82 and its journalling 83. The flange 84 is supported on the suction box in a corresponding way. The component rolls 71 and 81 are interconnected by the shaft 92. The shaft 92 is journalled 93 on a flange 94. The flange 94 is supported on the suction box (other figures). A small gap 90 is formed between the component rolls 71 and 81. By means of this gap 90, deflections of the fragmentary roll are brought under control. The wire is, however, sufficiently rigid, so that the gap 90 in the fragmentary roll does not produce a marking in the wire.

The fragmentary roll in accordance with the invention comprises at least the foregoing two component rolls 71,81, but it is also possible to use fragmentary rolls consisting of a higher number of roll-like parts. Most appropriately, a fragmentary roll comprises 3 to 5 component rolls.

The ratio of the diameter D of a component roll 71,81 of a fragmentary roll, to the diameter of a drying cylinder is within a range of 0.2–0.02, most appropriately within a range of 0.18–0.10.

The diameter D of a component roll 71,81 is 150–300 mm, most appropriately 200–270 mm. Such a small diameter roll can be placed in a more confined location than the group gap cylinders of the prior art solutions, whose diameters were even larger than 700 mm. Moreover, such a small diameter fragmentary roll has lower cost of manufacture.

The rigidity of the fragmentary roll is provided by its attachment to the frame of the suction box by means of the flanges 74,84,94.

Figure 6:
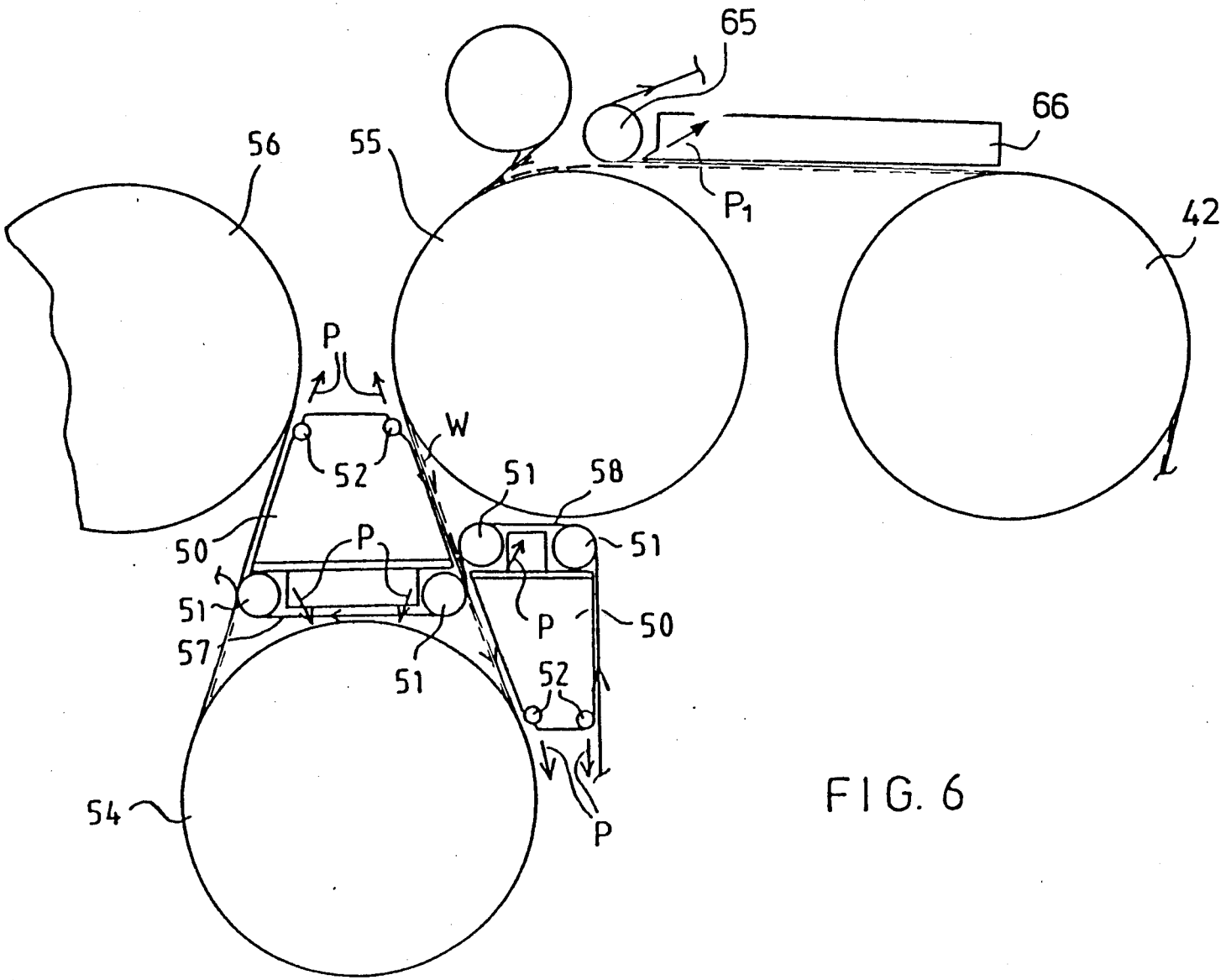
FIG. 6 is a schematic illustration of an exemplifying embodiment of the invention, wherein a blow box is employed.

FIG. 6 shows an exemplifying embodiment of a twin wire draw in accordance with the invention wherein the fragmentary rolls 51 are supported on blow boxes 50. The blow boxes 50 comprise blow nozzles 42, by means of which the air flows P are produced, which support the paper web and ventilate the pockets formed between the cylinders 54,55,56 and the wires 47,58.

In the group gap transfer shown in FIG. 6, a blow box 66 is used, wherein the air flows are directed in accordance with the arrow $P_1$ whereby the positive pressure formed at a nip point between the fragmentary roll 65 and the drying cylinder 55 can be eliminated. Such a blow box 66, wherein a negative pressure that supports the paper web W is produced by means of blowing, is described e.g., in FI Patent 67,107.

Figure 7:
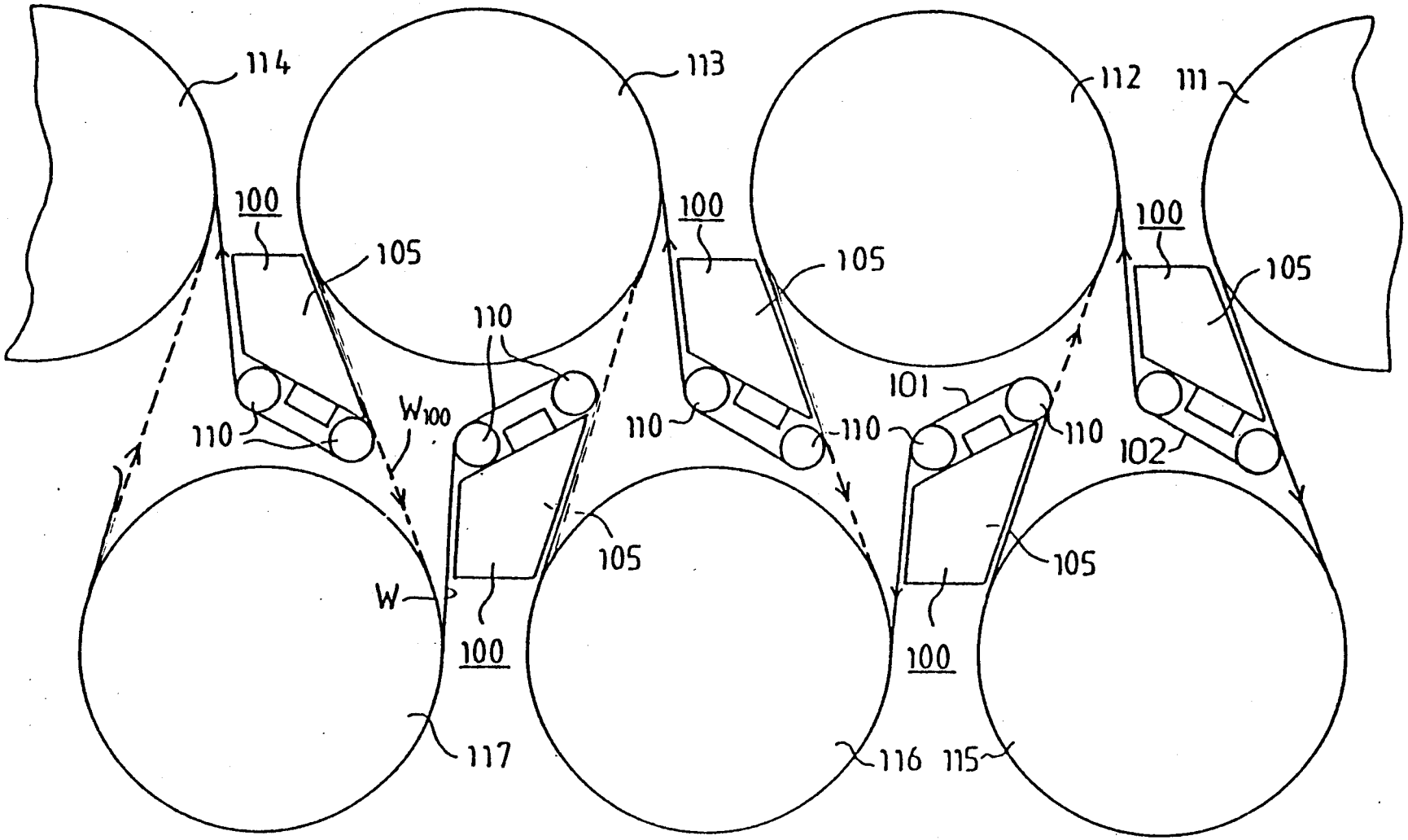
FIG. 7 shows diagramatically a further exemplifying embodiment of the invention.

FIG. 7 shows a twin-wire draw in a paper web W in accordance with the invention wherein the upper wire 102 runs over the upper cylinders 111,112,113,114 and the lower wire 101 runs over the lower cylinders 115,116,117. The wire guide members 100 comprise a suction box 105 and fragmentary rolls 110 attached to the same. In this exemplifying embodiment, an open draw is employed wherein short open draws $W_{100}$ are formed for the paper web.

As used herein, including the claims, the term "paper" includes also a paper-like material which may be passed about the drying cylinders of the dryer.

In the following, the patent claims will be given, whereby the various details of the invention may show variations within the scope of the inventive idea defined in said claims.

What is claimed is:

1. A multi-cylinder dryer comprising:

a set of drying cylinders including a plurality of upper drying cylinders and a plurality of lower drying cylinders, said drying cylinders being arranged to define a path for travel of a web of paper to run in a meandering fashion from one cylinder to a next cylinder of said set of cylinders so that the paper web is brought into direct contact with each cylinder within a sector that is larger than 180°, an upper wire draw and a lower wire draw each comprising wires for support of the paper web and for urging the paper web against the drying cylinder, a plurality of air-flow boxes for generating air streams, said air-flow boxes being selected from a class of boxes including suction boxes and blow boxes, a plurality of fragmentary rolls mounted on said air-flow boxes for guiding the paper web past the air streams; and wherein the wires of said upper draw and said lower draw press the paper web to be dried against faces of said drying cylinders, the wires being located for continuously supporting the paper web during travel of the web from one cylinder to a next cylinder of said set of cylinders;

there are at least two of said fragmentary rolls supported by each of said air-flow boxes; and said air-flow boxes direct the air streams at the wires of said upper and said lower draws to improve support contact between the paper web and said wires.

2. A dryer according to claim 1 wherein said upper wire draw and said lower wire draw constitute a twin-wire draw; and said upper wire draw and said lower wire draw run between individual ones of said fragmentary rolls in overlapping fashion to obtain a fully closed draw of the paper web.

3. A dryer according to claim 1 further comprising wire-guide members supporting said air-flow boxes; and wherein said wire-guide members minimize free runs of the paper web during a path of travel between an upper cylinder and a lower cylinder of said set of drying cylinders.

4. A dryer according to claim 1 wherein said upper wire draw and said lower drying wire draw constitute a twin-wire draw; and said fragmentary rolls are arranged in pairs, pairs of fragmentary rolls being disposed on respective ones of said air-flow boxes to support wires of said twin-wire draw in a substantially horizontal attitude during a running of the wires from one fragmentary roll to the next fragmentary roll in a pair of said fragmentary rolls.

5. A dryer according to claim 1 wherein each of said fragmentary rolls is supported on an end of an air-flow box and comprises at least two component rolls having ends journalled for rotation.

6. A dryer according to claim 1 wherein each of said air-flow boxes includes at least three flanges extending from the box for supporting one of said fragmentary rolls, the rolls being journalled in the flanges.

7. A dryer according to claim 1 wherein each of said fragmentary rolls comprises a plurality of component rolls and a shaft interconnecting the component rolls and providing for a gap between adjacent ones of said component rolls, said shaft being journalled to an air-flow box.

8. A dryer according to claim 1 wherein each of said fragmentary rolls has a diameter, and each of said drying cylinders has a diameter different from the diameter of a fragmentary roll, the ratio of the diameter of a fragmentary roll to the diameter of a drying cylinder being in a range of 0.07 to 0.20.

9. A dryer according to claim 1 wherein each of said fragmentary rolls has a diameter in a range of 150 to 300 millimeters.

* * * * *